US006535192B1

(12) United States Patent
Sung et al.

(10) Patent No.: US 6,535,192 B1
(45) Date of Patent: Mar. 18, 2003

(54) DATA DRIVING CIRCUIT FOR LIQUID CRYSTAL DISPLAY

(75) Inventors: Man Young Sung, Seoul (KR); Kyoung Moon Lim, Kwangmyong-shi (KR); Young Sik Kim, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 13 days.

(21) Appl. No.: 09/641,509

(22) Filed: Aug. 21, 2000

(30) Foreign Application Priority Data

Aug. 21, 1999 (KR) ..... 99-34811

(51) Int. Cl.[7] ..... G09G 3/36
(52) U.S. Cl. ..... 345/94; 345/99
(58) Field of Search ..... 345/95, 98, 99, 345/100, 94, 204, 213, 690

(56) References Cited

U.S. PATENT DOCUMENTS 5,170,158 A * 12/1992 Shinya ..... 345/98
5,477,234 A * 12/1995 Suzuki et al. ..... 345/98
5,489,918 A * 2/1996 Mosier ..... 345/690
5,940,061 A * 8/1999 Sato ..... 345/99
6,008,801 A * 12/1999 Jeong ..... 345/100
6,011,535 A * 1/2000 Katoh et al. ..... 345/100
6,040,816 A * 3/2000 Uchino ..... 345/99
6,111,557 A * 8/2000 Koyama et al. ..... 345/100
6,144,355 A * 11/2000 Murata et al. ..... 345/99
6,232,946 B1 * 5/2001 Brownlow et al. ..... 345/100
6,288,699 B1 * 9/2001 Kubota et al. ..... 345/99
6,320,565 B1 * 11/2001 Albu et al. ..... 345/98
6,384,806 B1 * 5/2002 Matsueda et al. ..... 345/95

* cited by examiner

*Primary Examiner*—Steven Saras
*Assistant Examiner*—Paul A. Bell
(74) *Attorney, Agent, or Firm*—McKenna Long & Aldridge LLP

(57) ABSTRACT

A data driving circuit for a liquid crystal display wherein it has a simplified circuit configuration so that it may be easily integrated to a liquid crystal display panel. In the data driving circuit, a data input device receives n-bit video data. A clock generator generates 2n different clock signals. A digital-to-analog converter array generates a sampling pulse having a different phase in accordance with a magnitude of the video data from the data input means using the 2n clock signals and sampling an input ramp signal in response to the sampling pulse to apply the sampled ramp signal to each of data lines in a liquid crystal panel. Accordingly, a circuit configuration of the digital-to-analog converter is simplified, so that the data driving circuit can be easily integrated onto a narrow area thereof.

6 Claims, 13 Drawing Sheets

DATA DRIVING CIRCUIT FOR LIQUID CRYSTAL DISPLAY

BACKGROUND OF THE INVENTION

1. Field of the Invention

This invention relates to a liquid crystal display, and more particularly to a data driving circuit for a liquid crystal display wherein data lines of a liquid crystal display panel are driven by a sampled ramp system.

2. Description of the Related Art

Recently, image media have been changed into a system of transmitting digital image signals easy to compress an information, instead of the existent analog image signals, in order to provide a high-resolution picture for a viewer. Accordingly, a liquid crystal display (LCD) as a type of image display device also must be driven with digital image signals instead of the existent analog image signals. To this end, a data driving circuit for the LCD converts the input digital image signals into analog signals and applies them to the liquid crystal display panel in such a manner to be suitable for driving pixels of the liquid crystal display panel requiring analog signals. However, the data driving circuit of digital system has a lot of problems in characteristic and throughput because it requires a greater number of input lines and has more complicated configuration in comparison to a sample/hold system as the existent analog system. Particularly, the data driving circuit of digital system must use digital-to-analog converters having a complex circuit configuration because a pixel data is processed in parallel. Hereinafter, a conventional data driving circuit will be described with reference to the accompanying drawings. In this case, it is assumed that the data driving circuit is driven by usually inputting 6-bit or 8-bit pixel data, but it is driven by inputting 3-bit pixel data for the convenience of explanation.

As shown in FIG. 1, the data driving circuit 20 for the LCD includes a first latch array 22 connected to a data bus 27, and a second latch array 24 and a digital-to-analog (D-A) converter array 26 connected to the first latch array 22 in cascade, so as to drive data lines DL1 to DLn included in a liquid crystal display panel 10. Each of the first and second latch arrays 22 and 24 consists of n latches, each of which has a 3-bit length to input 3-bit pixel data. The n latches included in the first latch array 22 are connected to the output terminal of a shift register 28 to be sequentially driven in accordance with a logical value of an output signal of the shift register 28, thereby sampling a pixel data VD from the data bus 27. The n latches included in the second latch array 24 receive pixel data from the n latches simultaneously to convert the same to the D-A converter array 26. Then, the D-A converter array 26 converts n pixel data from the second latch array 24 into analog signals using a method of sampling a ramp signal and applies the converted n pixel signals to the n data lines DL1 to DLn of the liquid crystal panel 10, respectively. To this end, the D-A converter array 26 consists of n D-A converters, each of which consists of a counter 21 and a sample holder 23. Each counter 21 receives 3-bit pixel data simultaneously to generate a sampling signal having a different pulse width in accordance with a logical value of the 3-bit pixel data. In other words, each counter 21 makes a down-count in accordance with an input clock signal to output a pulse width modulated signal corresponding to a size of the pixel data when the 3-bit pixel data has been set. Each sample holder 23 samples and holds a ramp signal inputted via a ramp signal line 25 in an output signal of the counter 21 to apply the same to the respective data lines DL1 to DLn. The sample and holder 23 consisting of a conventional switching transistor is turned on when an output signal of the counter 21 has a high state to charge a ramp signal RAMP inputted via the ramp signal line 25 in each data line DL1 to DLn. When an output signal of the counter 21 is changed into a low state, the sample holder 23 is turned off to maintain the lamp voltage charged in the data line in a turn-on interval. If such a D-A converter of sampled ramp system is used, it becomes possible to reduce an external voltage for analog to digital conversion by a single ramp signal as well as to obtain a relatively simple circuit configuration and an easy gamma correction, etc.

As described above, the conventional data driving circuit for the LCD includes the D-A converter, that is, the counter 21 and the sample holder 23 for each data line DL1 to DL1 so as to convert digital image data into analog image signals. However, the conventional data driving circuit has a drawback in that, since each counter 21 must load a pixel data and down-count the loaded pixel data to output a pulse width modulated signal proportional to a magnitude of the pixel data, it has a complicated circuit configuration. For instance, the counter 21 corresponding to one data line is configured as shown in FIG. 2. If 3-bit data B0, B1 and B2 have been set to first to third JK flip-flops by a load signal LOAD and an enable signal ENABLE, the counter 21 down-counts the set data value in accordance with a clock signal. Accordingly, when each output signal of the first to third JK flip-flops inputted to an OR gate positioned at an output terminal of the counter 21 becomes a low (0) state, the counter 21 stops its operation and outputs a low state of count signal. As a result, the output signal of the counter 21 becomes a pulse width modulated signal remaining at a high state in proportion to a magnitude of the input pixel data as shown in FIG. 3. For example, if image data of '010' and '111' are input, then the counter 21 outputs an output signal CNTo having a high-state pulse width in a time interval counting the input pixel data. Thus, the sample holder 23 charges a ramp signal inputted in a pulse width interval of the counter output signal in the data lines.

Meanwhile, a poly-Si system LCD has better device characteristic than an amorphous-Si system LCD so that a driving circuit can be fabricated on a substrate such as a liquid crystal display panel. Accordingly, the tendency is toward a data driving circuit with a small bulk to integrate the data driving circuit onto the liquid crystal panel for the sake of making a compact panel and a cost reduction of the driving integrated circuit. If the conventional data driving circuit is integrated onto the liquid crystal panel, however, a size of the liquid crystal panel becomes very large due to the complex D-A converters. As a result, the data driving circuit occupies a large area of the liquid crystal panel.

Accordingly, it is an object of the present invention to provide a data driving circuit for a liquid crystal display wherein it has a simplified circuit configuration so that it can be easily integrated onto a liquid crystal display panel.

In order to achieve these and other objects of the invention, a data driving circuit for a liquid crystal display according to an embodiment of the present invention includes data input means for inputting n-bit video data; clock generating means for generating 2n different clock signals; and a digital-to-analog converter array for generating a sampling pulse having a different phase in accordance with a magnitude of the video data from the data input means using the 2n clock signals and sampling an input ramp signal in response to the sampling pulse to apply the sampled ramp signal to each of data lines in a liquid crystal panel.

A data driving circuit for a liquid crystal display according to another embodiment of the present invention includes data input means for inputting n-bit video data; sequence pulse generating means for generating $2^n$ sequence pulses; and a digital-to-analog converter array for generating a sampling pulse having a different phase in accordance with a magnitude of the video data from the data input means using the $2^n$ sequence pulses and sampling an input ramp signal in response to the sampling pulse to apply the sampled ramp signal to each of data lines in a liquid crystal panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
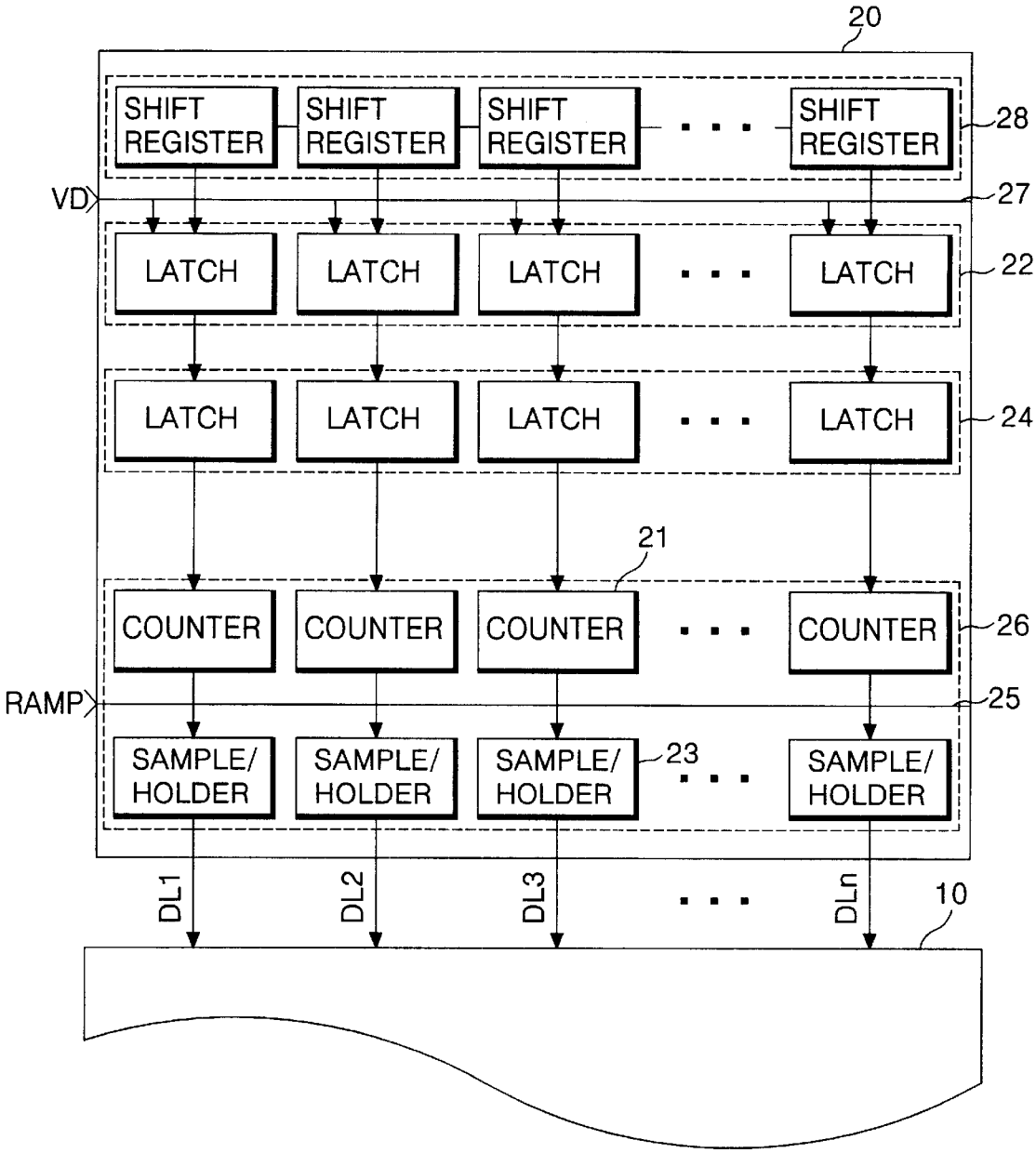
FIG. 1 RELATED ART
FIG. 1 is a block diagram showing a configuration of a conventional data driving circuit for a liquid crystal display.
Figure 2:
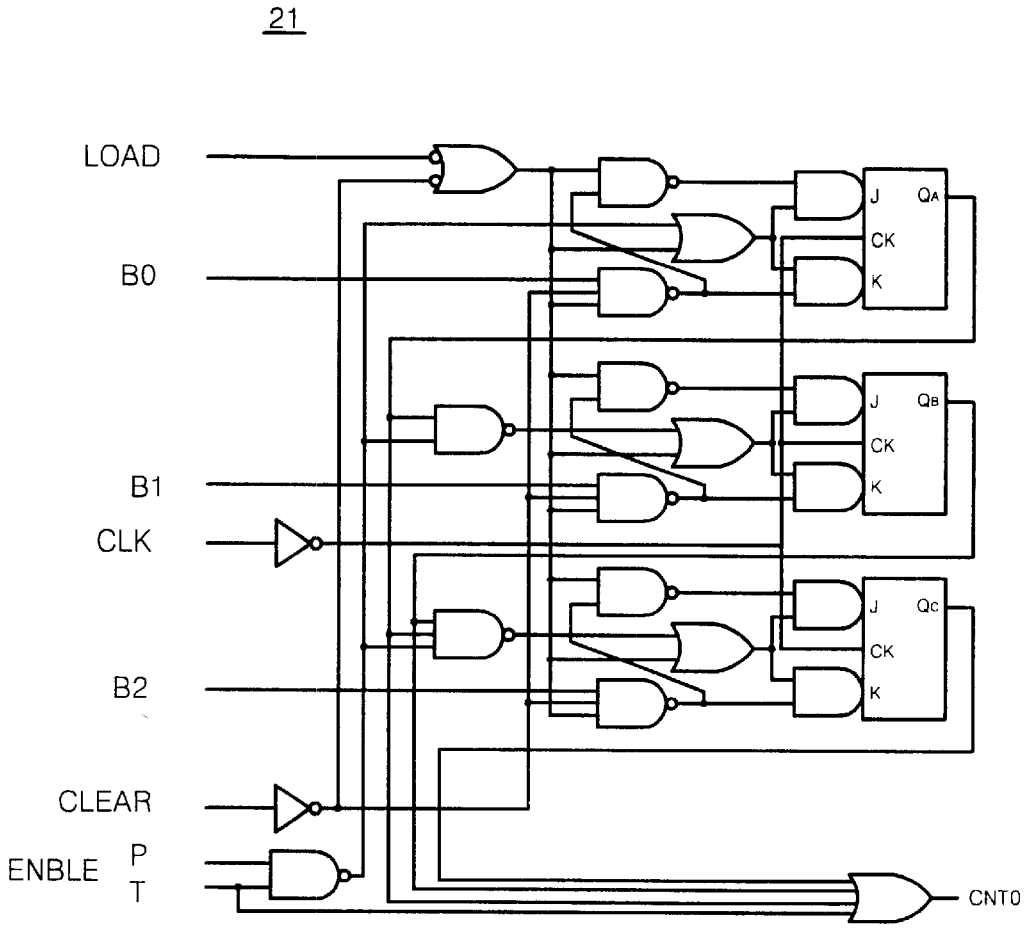
FIG. 2 PRIOR ART
FIG. 2 is a detailed circuit diagram of the counter shown in FIG. 1.
Figure 3:
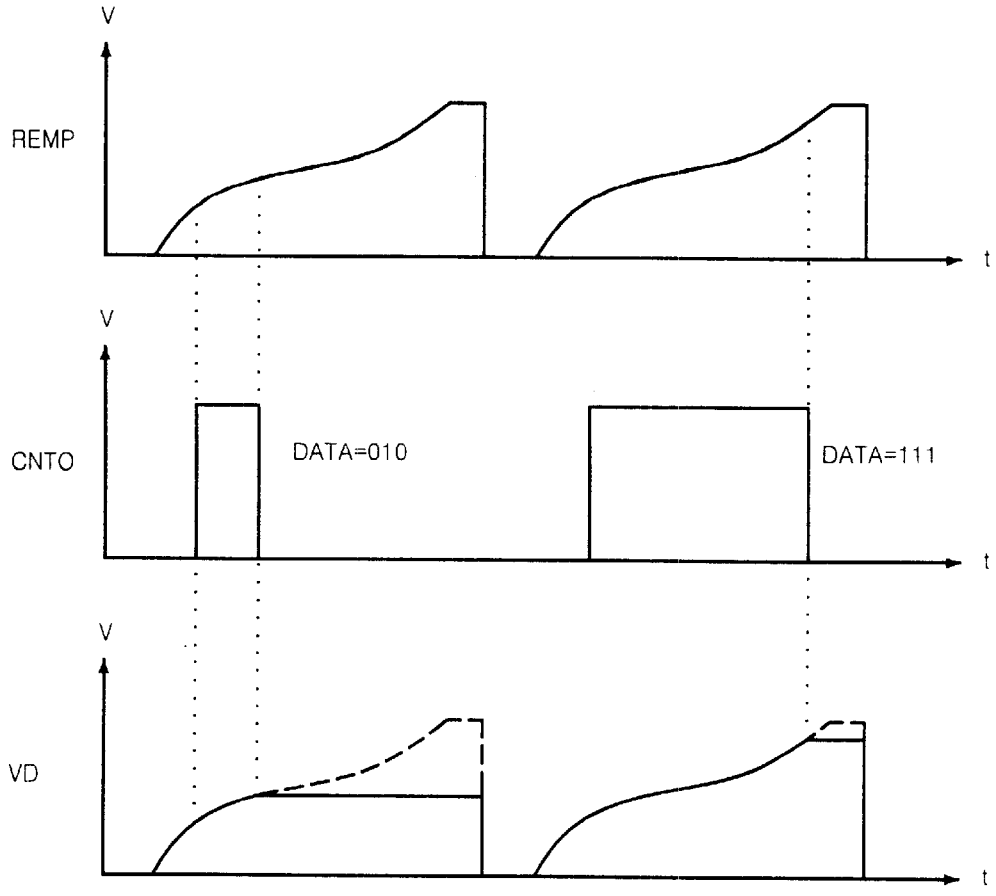
FIG. 3 PRIOR ART
FIG. 3 is waveform diagrams of a ramp signal, an output signal of the counter in FIG. 1 and a voltage charged in a data line in response to the output signal of the counter.
Figure 4:
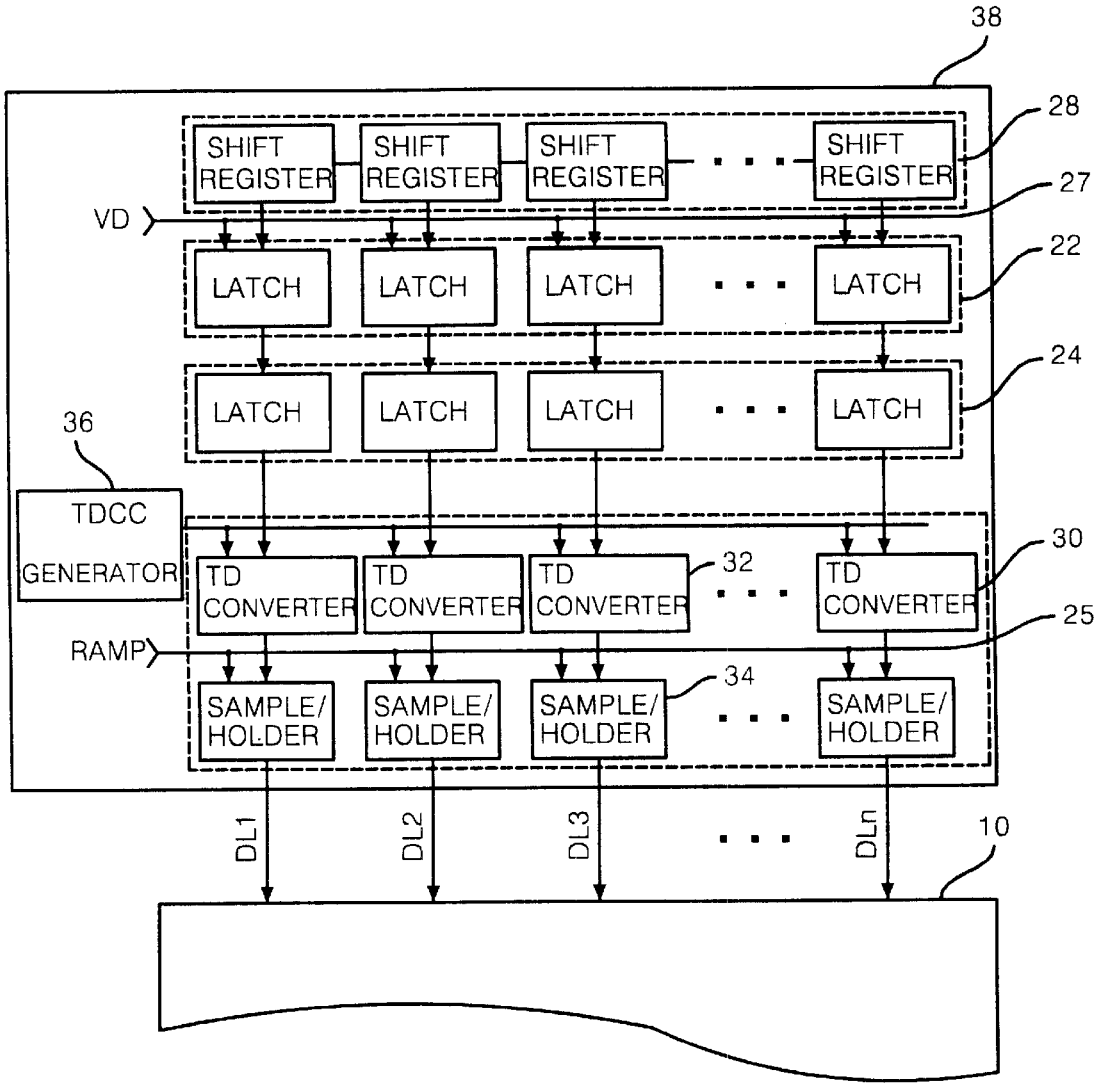
FIG. 4 is a block diagram showing a configuration of a data driving circuit for a liquid crystal display according to an embodiment of the present invention.

Referring to FIG. 4, there is shown a data driving circuit for a liquid crystal display (LCD) according to an embodiment of the present invention. In this case, it should be assumed that the data driving circuit is driven by usually inputting 6-bit or 8-bit pixel data, but it is driven by inputting 3-bit pixel data for the convenience of explanation. The data driving circuit includes shift registers 28 for generating a sequence pulse at a first latch array 22 connected to a data bus 27, a second latch array 24 connected to the first latch array 22, a time-data-conversion-clock (TDCC) generator 36 for generating three TDCC signals TDCC1 to TDCC3 having a different period from each other and three inverted TDCC signals /TDCC1 to /TDCC3, and a digital-to-analog (D-A) converter array 30 connected between the TDCC generator 36 and a liquid crystal display panel 10 to generate a sampling signal having a different timing in accordance with a magnitude of the input pixel data and thus sample and hold a ramp signal. Each of the first and second latch arrays 22 and 24 consists of n latches, each of which has a 3-bit length to input 3-bit pixel data. The n latches included in the first latch array 22 are connected to the output terminals of the shift registers 28 to be sequentially driven in accordance with a logical value of an output signal of each shift register 28, thereby sampling a pixel data VD from the data bus 27. In this case, the shift registers 28 usually divide the n latches into four blocks to drive them sequentially. The n latches included in the second latch array 24 input the pixel data from the n latches of the first latch array 22 simultaneously to transmit the same to the D-A converter array 30. The TDCC generator 36 generates three TDCC signals TDCC1 to TDCC3 that sequentially make an one-frequency-division, a two-frequency division and a three-frequency-division of a start clock signal STC inputted from the exterior thereof, and three inverted TDCC signals /TDCC1 to /TDCC3. The D-A converter array 30 generates a time-data (TD) signal, that is, a sampling signal having a different timing in accordance with a magnitude of the pixel data from the second latch array 24 and responds to this TD signal TD to sample a ramp signal RAMP inputted via a ramp signal line 25, thereby converting the pixel data into analog pixel signals to apply the same to each data line DL1 to DLn. To this end, the D-A converter array 30 includes n TD converters 32 for generating TD signals TD1 to TDn corresponding to n pixel data, and sample holders 34 commonly connected to the lamp signal line 25 and the n TD converters 32. Each of the n TD converters 32 responds to the pixel data inputted from each of the n latches of the second latch array 24 to select three TDCC signals of the six TDCC signals TDCC1 to TDCC3 and /TDCC1 to /TDCC3 generated from the TDCC generator 36 and make a logical sum operation of them, thereby generating the TD signals TD having a different timing in accordance with the pixel data. Each of the n sample holder 34 samples a ramp signal inputted via the ramp signal line 25 in accordance with the TD signal outputted from each of the n TD converters 32 to apply the same to each data line DL1 to DLn.

Figure 5:
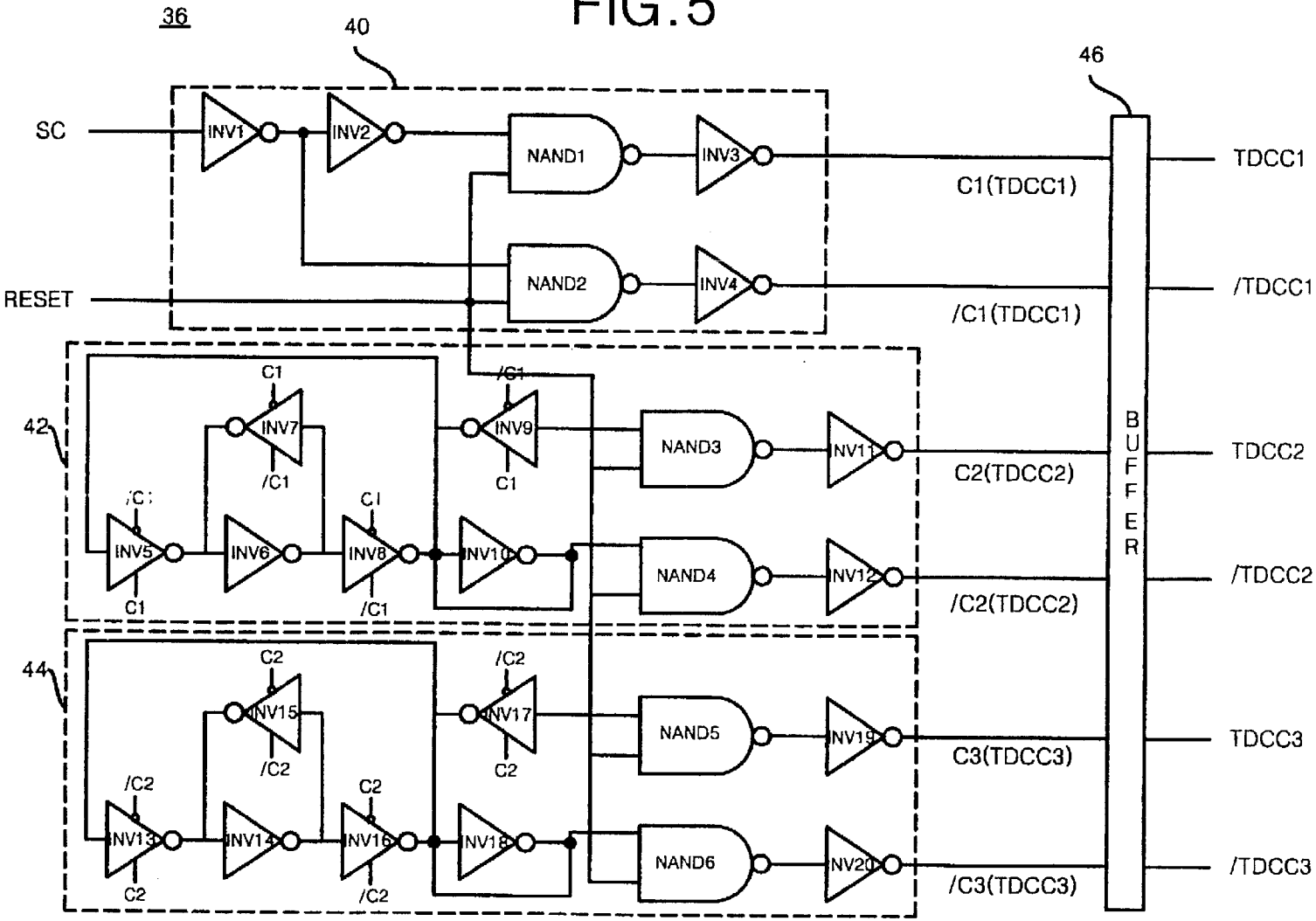
FIG. 5 is a detailed circuit diagram of the TDCC generator shown in FIG. 4.
Figure 6:
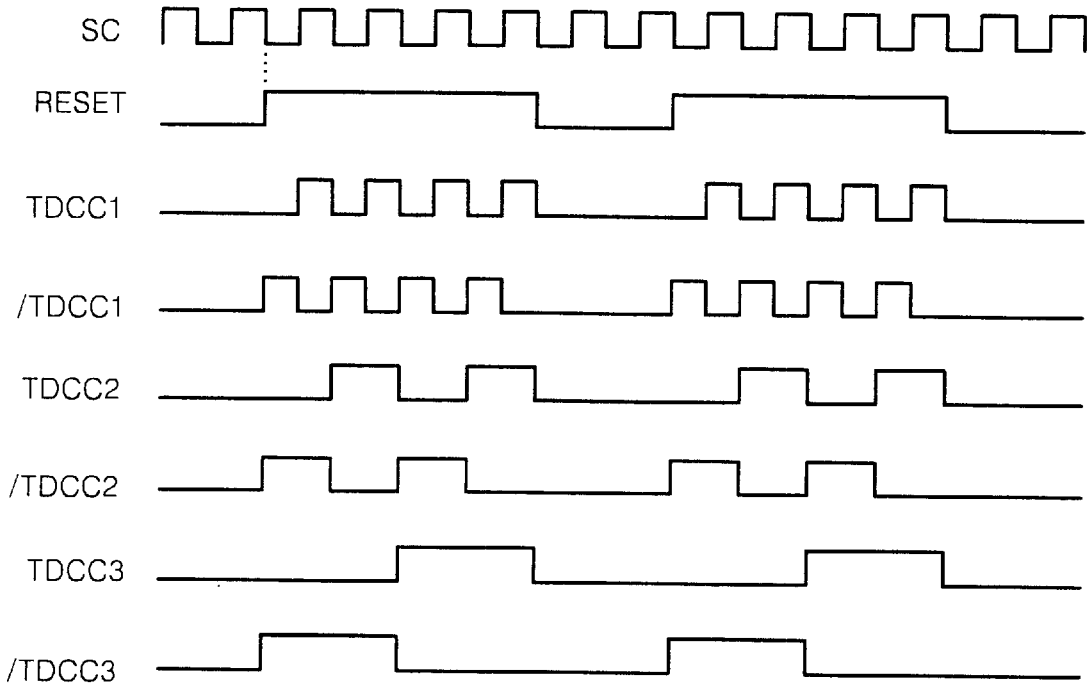
FIG. 6 is waveform diagrams of input and output signals of the TDCC generator shown in FIG. 5.

FIG. 5 represents a detailed circuit of the TDCC generator 36 in FIG. 4. In FIG. 5, the TDCC generator 36 includes a first frequency divider 40 for generating a first TDCC signal TDCC1 that makes an one-frequency-division of a clock signal SC inputted from the exterior thereof and an inverted first TDCC signal /TDCC1, a second frequency divider 42 for generating a second TDCC signal TDCC2 that makes a two-frequency-division of the clock signal SC and an inverted second TDCC signal /TDCC2, and a third frequency divider 44 for generating a third TDCC signal TDCC3 that makes a three-frequency-division of the clock signal SC and an inverted third TDCC signal /TDCC3. The first frequency divider 40 includes first and second inverter INV1 and INV2 for sequentially inverting the input clock signal SC, a first NAND gate NAND1 for making a NAND operation of an output of the second inverter INV2 and a reset signal RESET, a second NAND gate NAND2 for making a NAND operation of an output of the first inverter INV1 and the reset signal RESET, and third and fourth inverters INV3 and INV4 for individually inverting the output signals of the first and second NAND gates NAND1 and NAND2. Thus, the first frequency divider 40 outputs the first TDCC signal TDCC1 one-frequency-dividing the clock signal SC and the inverted first TDCC signal /TDCC1 only in a time interval when the reset signal RESET has a high state, as shown in FIG. 6. The second frequency divider 42 includes fifth to tenth inverters INV5 to INV10 for receiving the first TDCC signal TDCC1 and the inverted TDCC signal /TDCC1 from the first frequency divider 40 as control signals and outputting the same with remaining a state of the input signals during a half period of the first TDCC signal TDCC1, a third NAND gate NAND 3 for making a NAND operation of an output of the tenth inverter INV10 and the reset signal RESET, a fourth NAND gate for making a NAND operation of an output of the ninth inverter INV9 and the reset signal RESET, and eleventh and twelfth inverters INV11 and INV12 for individually output signals of the third and fourth NAND gates NAND3 and NAND4. Thus, the second frequency divider 42 outputs the second TDCC signal TDCC2 making a two frequency division of the clock signal SC and the inverted second TDCC signal /TDCC2 only in a time interval when the reset signal RESET has a high state as shown in FIG. 6. The third frequency divider 44 includes thirteenth to eighteenth inverters INV13 to INV 18 for receiving the second TDCC signal TDCC2 and the inverted second TDCC signal /TDCC2 from the second frequency divider 42 as a control signal to maintain a state of the input signal during a half period of the second TDCC signal TDCC2 and output the same, a fifth NAND gate NAND5 for making a NAND operation of the output of the inverter INV1 and the reset signal RESET, a six NAND gate NAND6 for making a NAND operation of the output of the inverter INV17 and the reset signal RESET, and 19th and 20th inverters INV19 and INV20 for individually inverting the output signals of the fifth and sixth NAND gates NAND5 and NAND6. Thus, the third frequency divider 44 outputs a third TDCC signal TDCC3 and an inverted third TDCC signal /TDCC3 making a two frequency division of the second TDCC signal TDCC2 and the inverted second TDCC signal /TDCC, respectively, only in a time interval when the reset signal RESET has a high state as shown in FIG. 6. The first to third TDCC signals TDCC1 to TDCC3 and the inverted first to third TDCC signals /TDCC1 to /TDCC3 outputted from the first to third frequency dividers 40, 42 and 44 are outputted, via a buffer 46 for preventing a glitch phenomenon of the output signals, to the TD converter 32.

Figure 7:
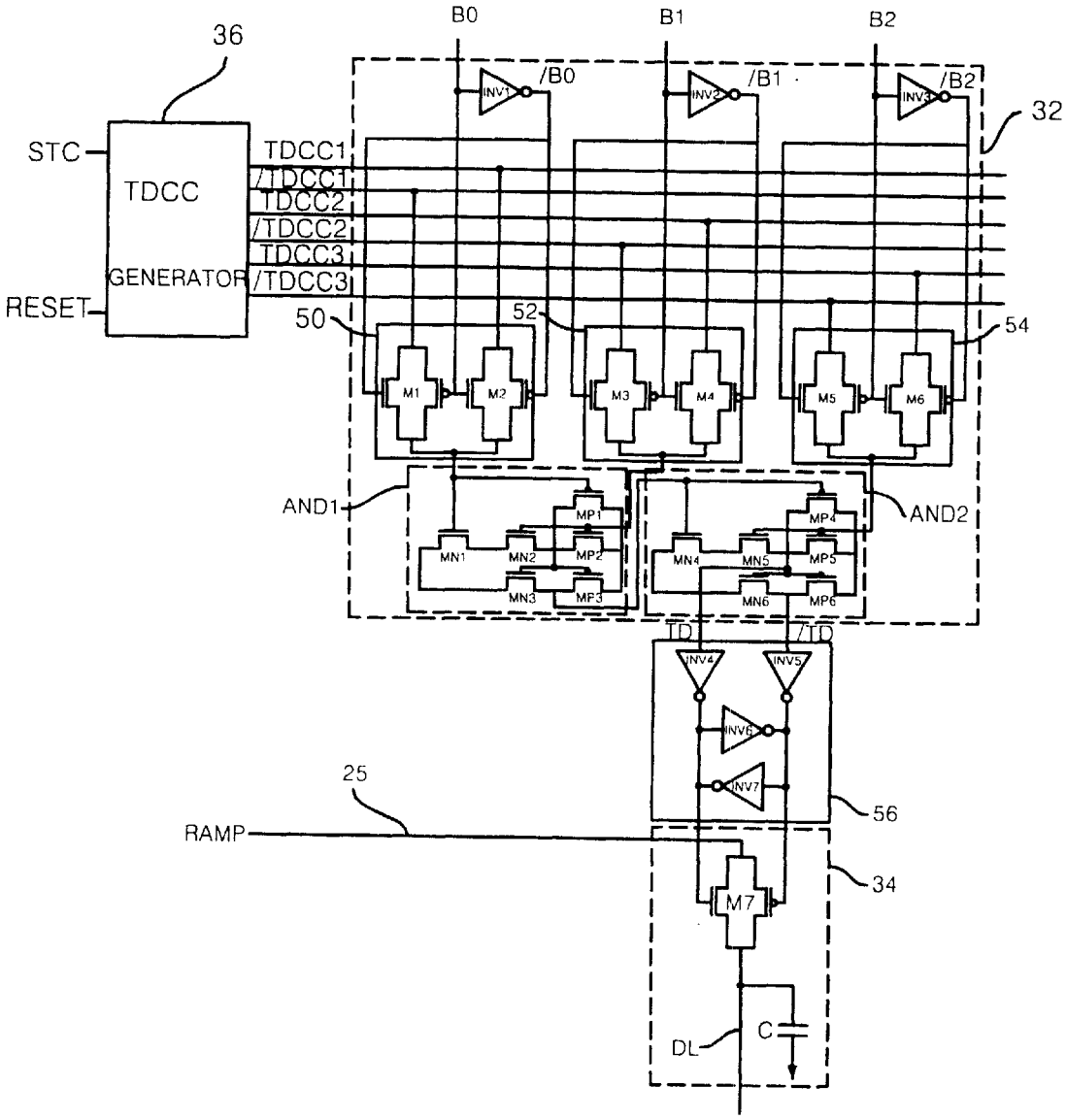
FIG. 7 is a detailed circuit diagram of the TD converter and the sample holder shown in FIG. 4.

FIG. 7 is a detailed circuit diagram of the TD converter 32 and the sample holder 34 shown in FIG. 4. In FIG. 7, the TD converter 32 includes first to third multiplexors 50 to 54 for selectively sampling six TDCC signals TDCC1 to TDCC3 and /TDCCT1 to /TDCC3 inputted from the TDCC generator 36 in accordance with three bit signals and inverted three bit signals inputted thereto. The first multiplexor 50 selectively samples the first TDCC signal TDCC1 and the inverted first TDCC signal /TDCC1 outputted from the TDCC generator 36 in accordance with logical values of a first bit signal B0 and an inverted first bit signal /B0 inverted by the first inverter INV1. To this end, the first multiplexor 50 consists of first and second transistor pairs M1 and M2 for receiving the first bit signal B0 and the inverted first bit signal /B0 as control signals to sample the first TDCC signal TDCC1 and inverted first TDCC signal /TDCC1, respectively. The first transistor pair M1 consists of a NMOS transistor for receiving the inverted first bit signal /B0 as a control signal and a PMOS transistor for receiving the first bit signal B0 as a control signal. On the other hand, the second transistor pair M2 consists of an NMOS transistor for receiving the first bit signal B0 as a control signal and a PMOS transistor for receiving the inverted first bit signal /B0 as a control signal. Accordingly, the first and second transistor pairs M1 and M2 make an contrary operation in accordance with a logical value of the first bit signal B0. For example, when a high-state first bit signal B0 is input, the second transistor pair M2 are simultaneously turned on to sample and output the first TDCC signal TDCC1. On the other hand, when a low-state first bit signal B0 is input, the first transistor pair M1 is simultaneously turned on to sample and output the inverted first TDCC signal /TDCC1. The second multiplexor 52 consists of third and fourth transistor pairs M3 and M4 for receiving a second bit signal B1 and an inverted second bit signal /B1 as a control signals to sample the second TDCC signal TDCC2 and the inverted TDCC signal TDCC2, respectively. The third and fourth transistor pairs M3 and M4 also make a contrary operation in accordance with a logical value of the second bit signal B1 as mentioned above. For example, when a high-state second bit signal B1 is input, the fourth transistor pair M4 is simultaneously turned on to sample and output the second TDCC signal TDCC2. On the other hand, when a low-state second bit signal B1 is input, the third transistor pair M3 is simultaneously turned on to sample and output the inverted second TDCC signal /TDCC2. The third multiplexor 54 consists of fifth and sixth transistor pairs M5 and M6 for receiving a third bit signal B2 and an inverted third bit signal /B2 as control signals to sample the third TDCC signal TDCC3 and the inverted third TDCC signal /TDCC3, respectively. Likewise, the fifth and sixth transistor pairs M5 and M6 make a contrary operation in accordance with a logical value of the third bit signal B2 as mentioned above. For example, when a high-state third bit signal B2 is input, the sixth transistor pair M6 is simultaneously turned on to sample and output the third TDCC signal TDCC3. On the other hand, when a low-state third bit signal B2 is input, the fifth transistor pair M5 is simultaneously turned on to sample and output the inverted third TDCC signal /TDCC3.

Figure 8:
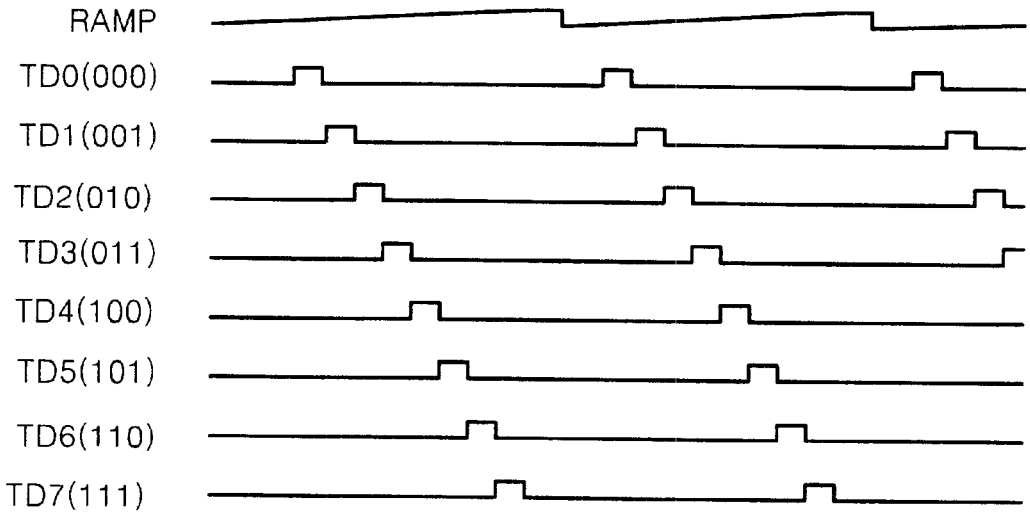
FIG. 8 is waveform diagrams of signals outputted in response to a pixel data in the TD converter shown in FIG. 7.
Figure 9:
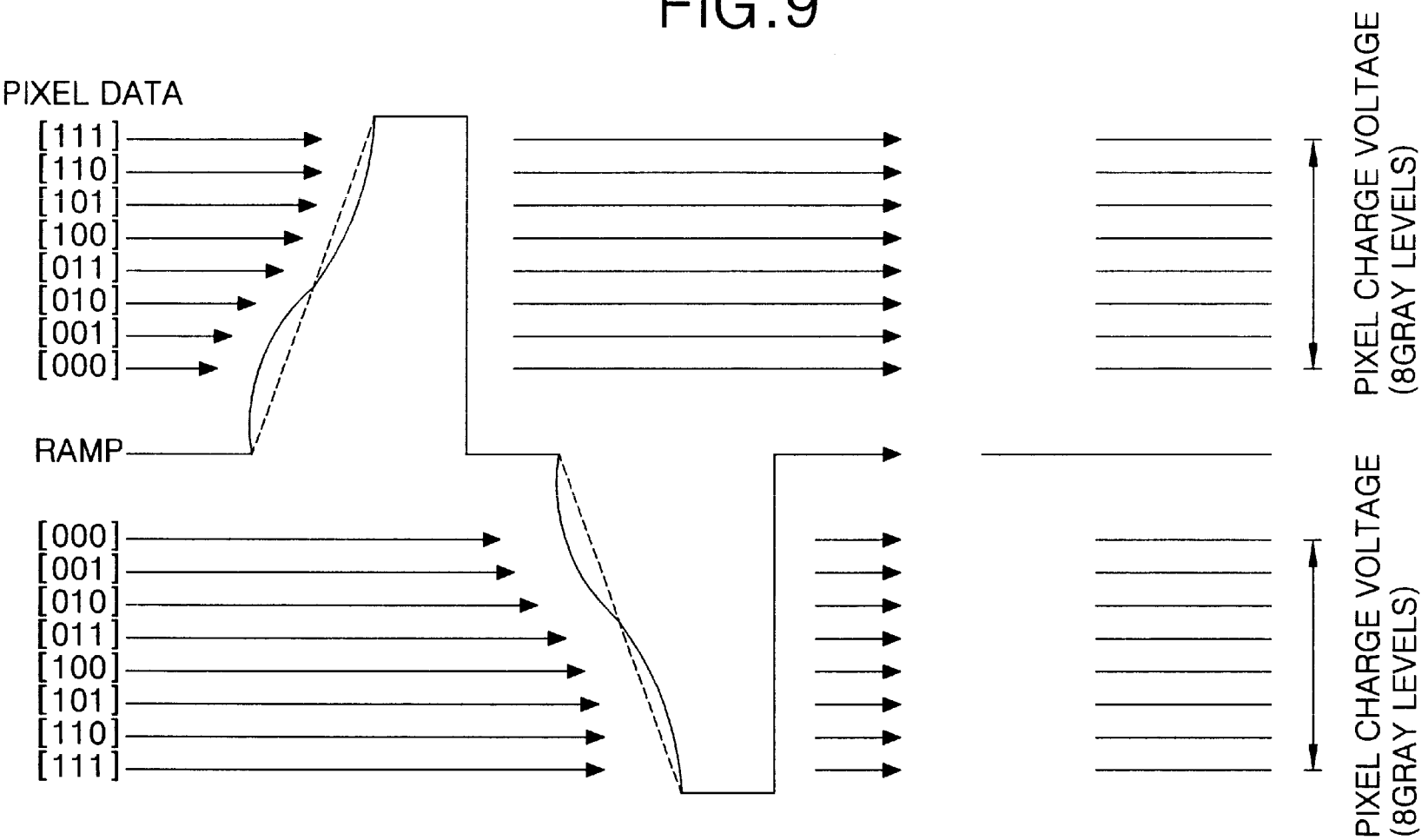
FIG. 9 represents a sample/hold position of a ramp signal corresponding to the output signal of the TD converter shown in FIG. 8 and a pixel charge voltage charged in the data line accordingly.

The TD converter 32 further includes a first AND gate AND1 for making a logical sum operation of the output signals of the first and second multiplexors 50 and 52, and a second AND gate AND2 for making a logical sum operation of the output signals of the first AND gate AND1 and the third multiplexor 54. The first AND gate AND1 consists of first to third NMOS transistors MN1 to MN3 and first to third PMOS transistors MP1 to MP3, and which makes a logical sum operation of the output signals of the first and second multiplexors 50 and 52 and outputs the same as shown in FIG. 6. The second AND gate AND2 consists of fourth to sixth NMOS transistors MN4 to MN6 and fourth to sixth PMOS transistors MP4 to MP6, and which makes a logical sum operation of the output signals of the first AND gate AND1 and the third multiplexor 54. Thus, an output signal TD of the TD converter 32 outputted from the second AND gate AND2 becomes any one of first to seventh TD signals TD1 to TD7 having a different timing in accordance with a magnitude of 3-bit input pixel data as shown in FIG. 8. In this case, the second AND gate AND2 outputs the TD signal and the inverted TD signal /TD simultaneously so as to drive the transistor pair M7 in the sample holder 34 at the same time. The TD signal and the inverted TD signal /TD from the second AND gate AND2 are outputted, via a buffer 56 consisting of the fourth to seventh inverters INV4 to INV7, to the sample holder 34 as shown in FIG. 7 so as to prevent a glitch phenomenon of the output signals. The sample holder 34 consists of a transistor pair M7 and a charge capacitor C. The transistor pair M1 of the sample holder 34 are simultaneously turned on when the TD signal TD inputted, via the buffer 56, from the TD converter 32 has a high state to sample a ramp signal RAMP inputted over the lamp signal line 25, thereby charging the sampled ramp signal RAMP in the charge capacitor C and applying the same to the data line DL. In other words, the sample holder 34 samples a ramp signal RAMP applied during one horizontal scanning interval as shown in FIG. 9 by the TD signal TD outputted in response to the input pixel data from the TD converter 32. Thus, an analog pixel signal complying with any one of 8 gray levels corresponding to each of 3-bit pixel data as shown in FIG. 9 is applied to the data line DL as a pixel charging voltage.

As described above, in the data driving circuit according to the present invention, the D-A converter selects n TDCC signals of 2n TDCC signals outputted from the TDCC generator in response to an input n-bit pixel data and makes a logical sum operation of them, thereby outputting a TD signal corresponding to the input pixel data, that is, a sampling pulse and then sampling a ramp signal in response to the sampling pulse to convert a digital data into analog signals. In this case, the TD converter generating the sampling pulse corresponding to n-bit pixel data has a simpler circuit configuration in comparison to the conventional counter that loads the n-bit pixel data and counts the loaded value.

Figure 10:
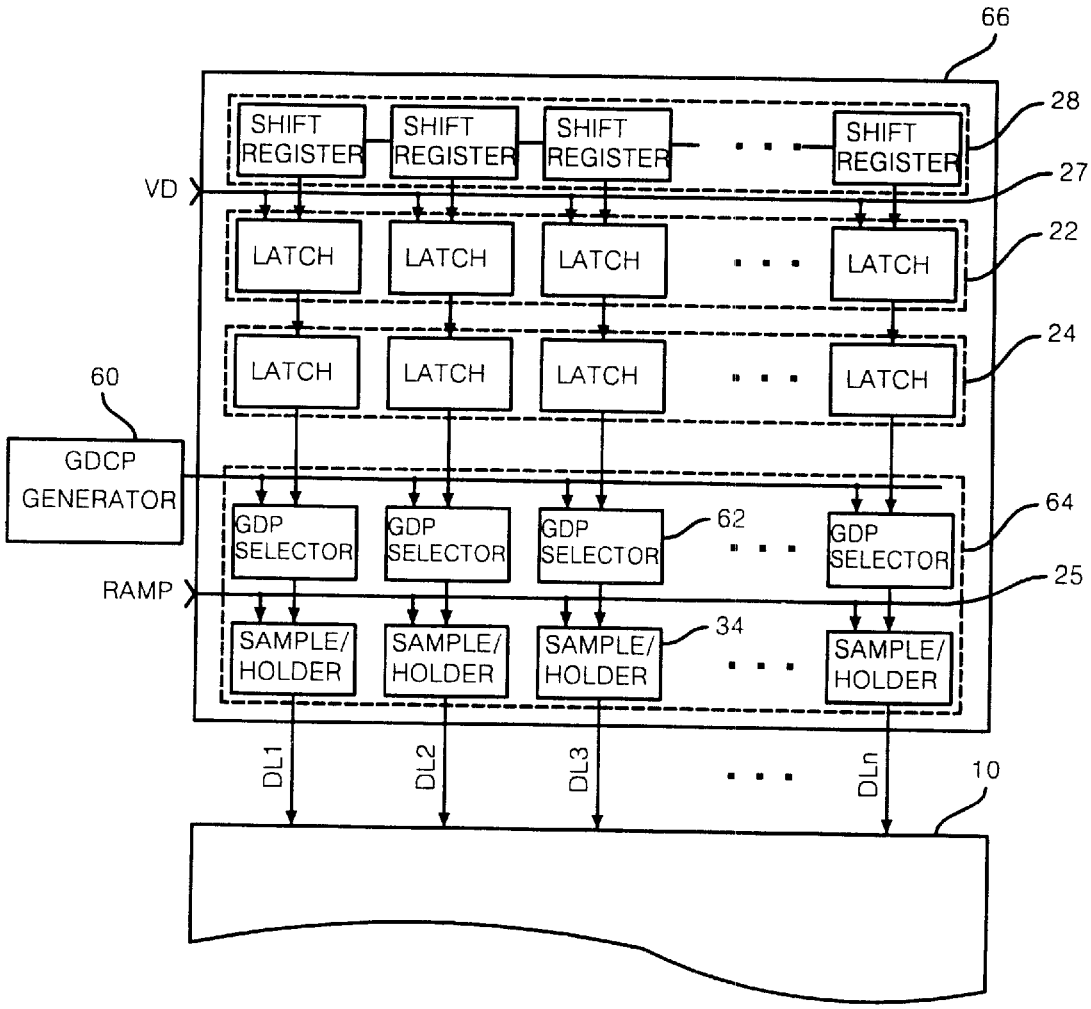
FIG. 10 is a block diagram showing a configuration of a data driving circuit for a liquid crystal display according to an embodiment of the present invention.

Referring now to FIG. 10, there is shown a data driving circuit for a LCD according to another embodiment of the present invention. The data driving circuit 66 has the same elements as the data driving circuit shown in FIG. 4 except that the TDCC generator 36 and the TD converter 32 in FIG. 4 are replaced by a gray-data-conversion-pulse (GDCP) generator 60 and a gray-data-pulse (GDP) selector 62. A detailed explanation as to the elements identical to that of the data driving circuit in FIG. 4 will be omitted.

Figure 11:
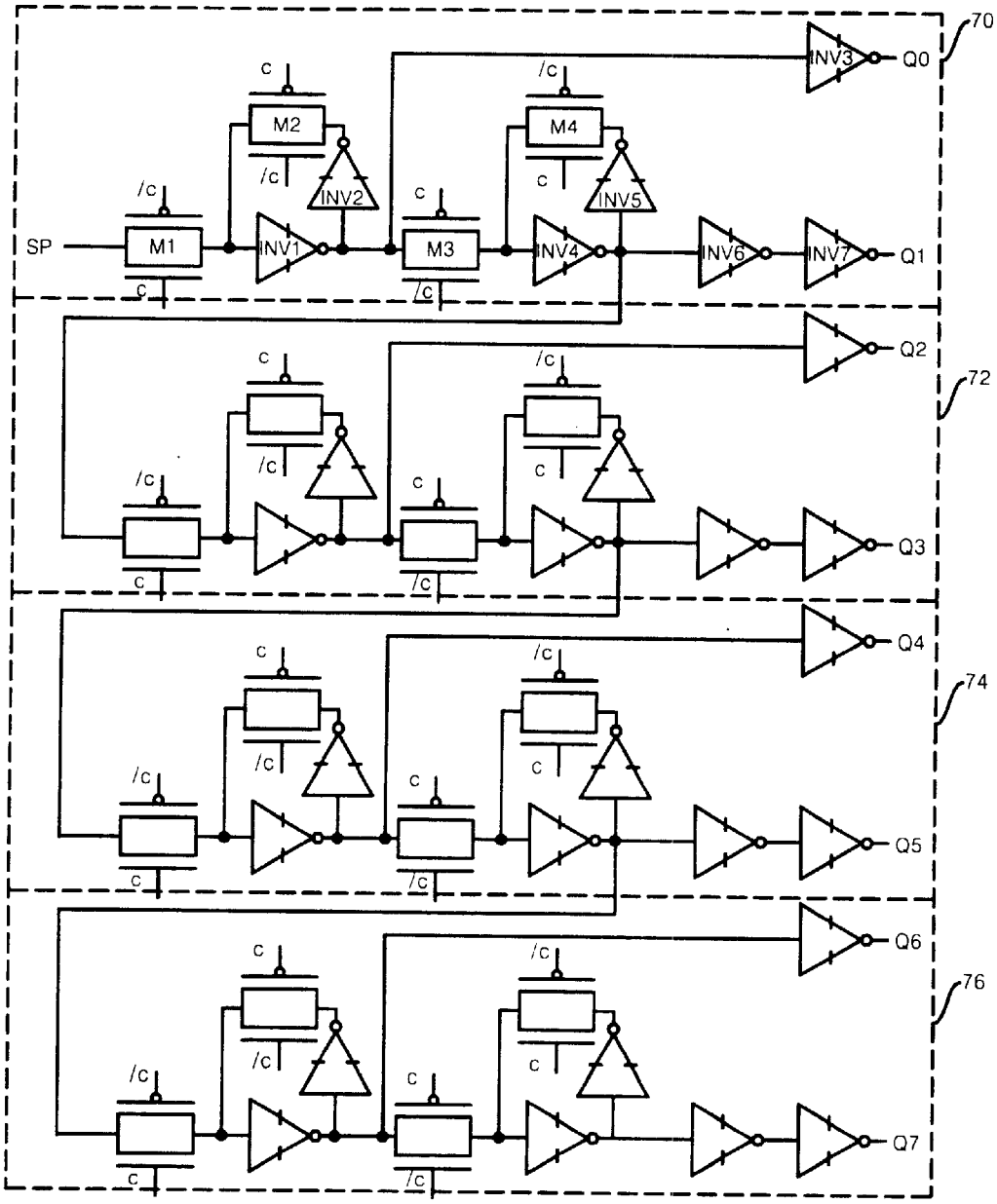
FIG. 11 is a detailed circuit diagram of the GDCP generator shown in FIG. 10.
Figure 12:
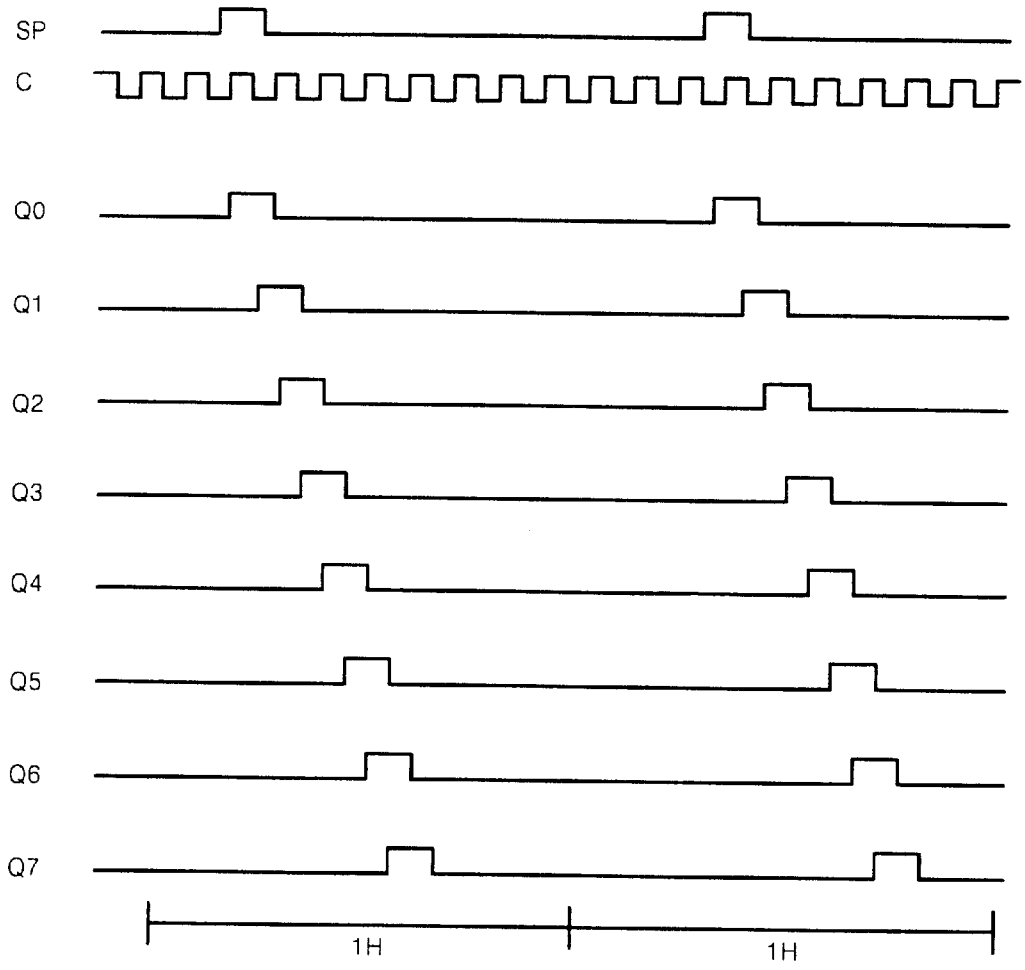
FIG. 12 is waveform diagrams of input and output signals of the GDCP generator shown in FIG. 11.

In FIG. 10, the GDCP generator 60 sequentially shifts a start pulse SP inputted from the exterior thereof to output 8 pulse signals Q0 to Q7 having a different phase from each other. In other words, the GDCP generator 60 includes four stages 70 to 76 as shift registers as shown in FIG. 11. The first stage 70 allows an input start pulse SP to be outputted into a first shift pulse Q0 shifted by a desired interval of an input clock signal C as shown in FIG. 12 via first and second transistor pairs M1 and M2 and first to third inverters INV1 to INV3. Also, the first stage 70 outputs a second shift pulse Q1 shifting the first shift pulse Q0 by a half period of the clock signal C as shown in FIG. 12 via third and fourth transistor pairs M3 and M4 connected to an output terminal of the second inverter INV2 and fourth to seventh inverters INV4 to INV7. The second stage 72 having the same elements as the first stage receives the second shift pulse Q1 from the first stage 70 to output third and fourth shift pulses Q2 and Q3 shifted sequentially by a ½ period of the clock signal C as shown in FIG. 12. Furthermore, the third and fourth stages 74 and 76 also receive shift pulses at the previous stage to output fifth to eighth shift pulses Q4 to Q7 shifted sequentially as shown in FIG. 12.

Figure 13:
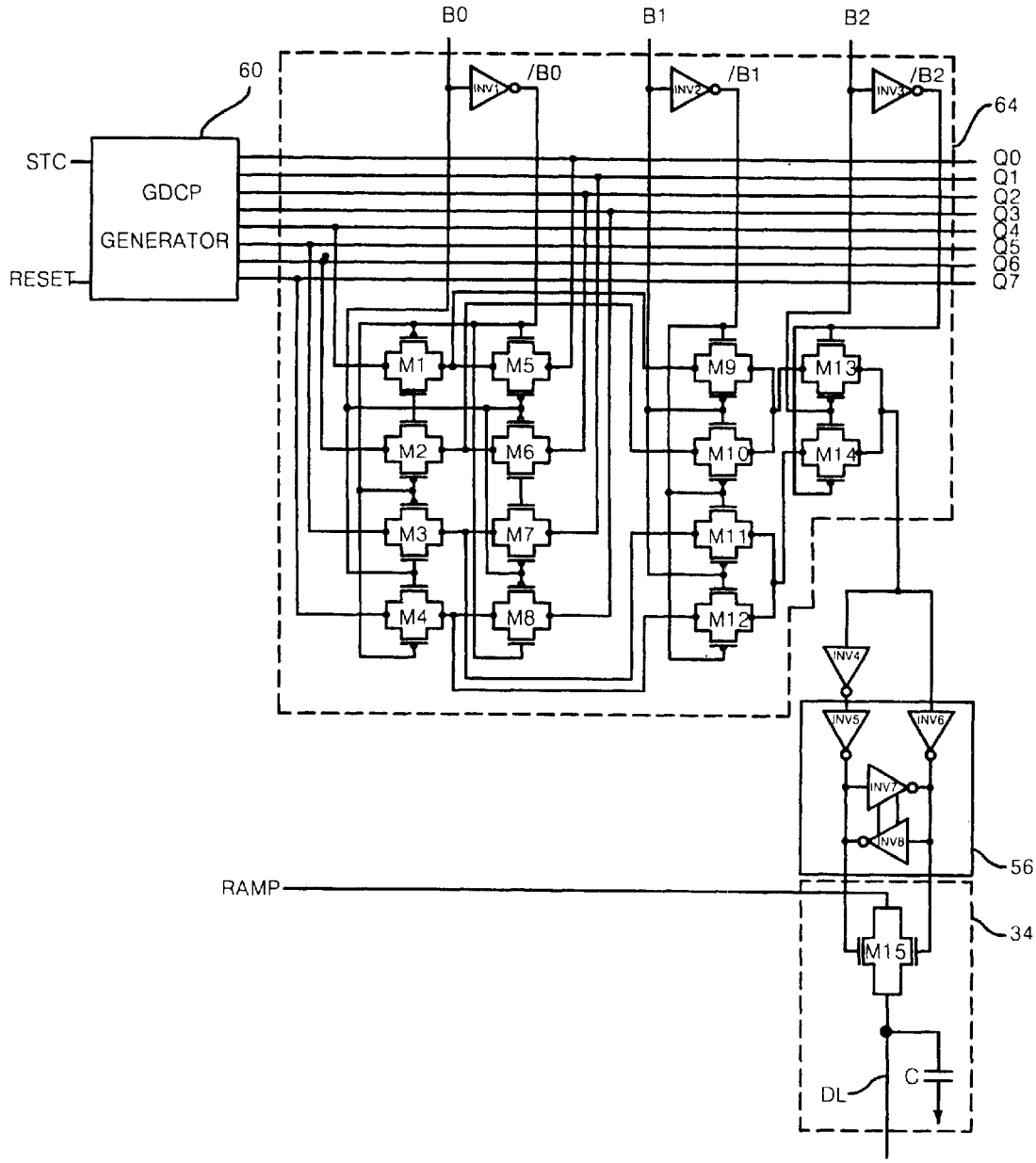
FIG. 13 is a detailed circuit diagram of the GDP selector and the sample holder shown in FIG. 10.

Each of the n GDP selectors 62 selects any one of the first to eighth shift pulses Q0 to Q7 generated from the GDCP generator 60 in response to a pixel data inputted from each of n latches in the second latch array 24 to generate a GDP signal GDP having a different phase in accordance with the pixel data. To this end, the GDP selector 62 is implemented by a multiplexor consisting of first to fourteenth transistor pairs M1 to M14 as shown in FIG. 13. Since each of the 14 transistor pairs M1 to M14 consists of a NMOS transistor and a PMOS transistor and is driven at the same time, an output current thereof is increased. The first shift pulse Q0 from the GDCP generator 60 is applied to the fifth transistor pair M5, the second shift pulse Q1 to the seventh transistor pair M7, the third shift pulse Q2 to the sixth transistor pair M6, the fourth shift pulse Q3 to the eighth transistor pair M8, the fifth shift pulse Q4 to the first transistor pair M1, the sixth shift pulse Q5 to the third transistor pair M3, the seventh shift pulse Q6 to the second transistor pair M2, and the eighth shift pulse Q7 to the fourth transistor pair M4. The outputs of the first and fifth transistors M1 and M5 are connected to an input of the eighth transistor pair M9, the outputs of the second and sixth transistor pairs M2 and M6 to an input of the tenth transistor pair M10, the outputs of the third and seventh transistor pairs M3 and M7 to an input of the eleventh transistor pair M11, and the outputs of the fourth and eighth transistor pairs M4 and M8 to an input of the twelfth transistor pair M12. Further, the outputs of the ninth and tenth transistor pairs M9 and M10 are connected to an input of the third transistor pair M13, and the outputs of the eleventh and twelfth transistor pairs M11 and M12 are connected to an input of the fourteenth transistor pair M14. Accordingly, the first to eighth transistor pairs M1 to M8 are selectively driven with a first bit signal B0 from the second latch and an inverted bit signal inverted by the first inverter INV1 to select and output any four pulses of the first to eighth shift pulses Q0 to Q7. The ninth to twelfth transistor pairs M9 to M12 are selectively driven with a second bit signal B1 and an inverted second bit signal /B1 inverted by the second inverter INV2 to select and output any two signals of the four output signals from the first to eighth transistor pairs M1 to M8. The thirteenth and fourteenth transistor pairs M13 and M14 are selectively driven with a third bit signal B2 and an inverted third bit signal /B2 inverted by the third inverter INV3 to select and output any one of the two output signals from the ninth to twelfth transistor pairs M9 to M12. For example, when the first bit signal B0 has a low state of '0', all of the fifth to ninth transistor pairs M5 and M9 are turned on to conduct the first to fourth shift pulses Q0 to Q3. On the other hand, when the first bit signal B0 has a high state of '1', all of the first to fourth transistor pairs M1 to M4 are turned on to conduct the fifth to eighth shift pulses Q4 to Q7. Next, when the second bit signal B3 has a high state of '1', the tenth and twelfth transistor pairs M10 and M12 are turned on to select and conduct the second and third shift pulses Q2 and Q3 of the first to fourth shift pulses Q0 to Q3 applied from the fifth to ninth transistor pairs M5 and M9. When the third bit signal B2 has a low state of '0', the thirteenth transistor pair M13 only is turned on to select and conduct the third shift pulse Q2 on the second and third shift pulses Q2 and Q3 applied from the tenth and twelfth transistor pairs M10 and M12. As described above, if a pixel data of '010' is input, then the GDP selector 62 selects the third shift pulse Q2 corresponding thereto to output the same as a GDP signal. The GDP signal outputted from the GDP selector 62 is inverted by means of the fourth inverter INV4. The GDP signal GDP and the inverted GDP signal /GDP are outputted, via a buffer 56 consisting of the fifth to eighth inverters INV5 to INV8 as shown in FIG. 13, to the sample holder 34 so as to prevent a Glitch phenomenon of the output signals. The transistor pair M15 of the sample holder 34 is simultaneously turned on when the GDP signal GDP inputted, via the buffer 56, from the GDP selector 62 has a high state to sample a ramp signal inputted over the ramp signal line 25, thereby charging the sampled ramp signal in the charge capacitor C to apply the same to the data line DL. Accordingly, an analog pixel signal complying with any one of 8 gray levels corresponding to each of 3-bit pixel data as shown in FIG. 9 is applied to the data line DL as a pixel charging voltage.

As described above, in the data driving circuit according to another embodiment of the present invention, the D-A converter selects any one of $2^n$ shift pulses outputted from the GDCP generator in response to an input n-bit pixel data and samples a ramp signal in response to the selected signal, thereby converting a digital data into analog signals. In this case, the GDP selector generating the sampling signal corresponding to n-bit pixel data has a simpler circuit configuration in comparison to the conventional counter that loads the n-bit pixel data and counts the loaded value.

As described above, according to the present invention, since the D-A converter for converting a digital data into analog signals by generating a sampling pulse in response to the pixel data and then sampling the ramp signal in response to the sampling pulse is used, a circuit configuration of the D-A converter can be simplified.

Accordingly, the data driving circuit for LCD according to the present invention can be easily integrated onto a narrow area thereof.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A data driving circuit for a liquid crystal display, comprising:

data input means for inputting n-bit video data;

clock generating means for generating 2n different clock signals; and a digital-to-analog converter array for generating a sampling pulse having a different phase in accordance with a magnitude of the video data from the data input means using the 2n clock signals and sampling an input ramp signal in response to the sampling pulse to apply the sampled ramp signal to each of the data lines in a liquid crystal panel.

2. The data driving circuit as claimed in claim 1, wherein the clock generating means generates n clock signals, each of which has a period increased by two times, and n clock signals inverted therefrom.

3. The data driving circuit as claimed in claim 1, wherein each analog-to-digital converter included in the analog-to-digital converter array and connected to each of the data lines comprises:

a time-to-data converter for selecting n clock signals of the 2n clock signals in response to the n-bit video data and making a logical sum operation of the selected n clock signals to output the same as the sampling signal; and sampling/holding means for sampling and holding the input ramp signal in response to the sampling signal from the time-to-data converter to apply the same to the corresponding data line.

4. A data driving circuit for a liquid crystal display, comprising:

data input means for inputting n-bit video data;

sequence pulse generating means for generating $2^n$ sequence pulses; and a digital-to-analog converter array for generating a sampling pulse having a different phase in accordance with a magnitude of the video data from the data input means using the $2^n$ sequence pulses and sampling an input ramp signal in response to the sampling pulse to apply the sampled ramp signal to each of the data lines in a liquid crystal panel.

5. The data driving circuit as claimed in claim 4, wherein the sequence pulse generating means is a shift register that generates $2^n$ sequence pulses shifted sequentially at a desired phase difference in response to an input start pulse.

6. The data driving circuit as claimed in claim 4, wherein each analog-to-digital converter included in the analog-to-digital converter array and connected to each of the data lines comprises:

a gray-data-pulse selector for selecting any one of the $2^n$ clock signals in response to the n-bit video data to output the selected signal as the sampling signal; and sampling/holding means for sampling and holding the input ramp signal in response to the sampling signal from the gray-data-pulse selector to apply the same to the corresponding data line.

* * * * *